US010046935B2

(12) United States Patent
Kim

(10) Patent No.: US 10,046,935 B2
(45) Date of Patent: Aug. 14, 2018

(54) MULTI-BANKNOTE CASSETTE WITH MOVABLE STOPPER AND BANKNOTE STACKING METHOD THEREOF

(71) Applicant: Nautilus Hyosung Inc., Seoul (KR)

(72) Inventor: Jong Woo Kim, Seoul (KR)

(73) Assignee: NAUTILUS HYOSUNG INC., Seoul (KR)

( * ) Notice: Subject to any disclaimer, the term of this patent is extended or adjusted under 35 U.S.C. 154(b) by 0 days.

(21) Appl. No.: 15/288,976

(22) Filed: Oct. 7, 2016

(65) Prior Publication Data

US 2017/0240373 A1 Aug. 24, 2017

(30) Foreign Application Priority Data

Feb. 24, 2016 (KR) ..... 10-2016-0021612

(51) Int. Cl.

| | |
|---|---|
| ***B65H 31/20*** | (2006.01) |
| ***B65H 29/52*** | (2006.01) |
| ***B65H 31/10*** | (2006.01) |
| ***B65H 83/02*** | (2006.01) |
| ***G07D 11/00*** | (2006.01) |

(Continued)

(52) U.S. Cl.

CPC ..... *B65H 31/20* (2013.01); *B65H 29/52* (2013.01); *B65H 31/10* (2013.01); *B65H 83/025* (2013.01); *G07D 7/17* (2017.05); *G07D 11/0006* (2013.01); *G07D 11/0018* (2013.01); *G07D 11/0027* (2013.01); *B65H 31/36* (2013.01); *B65H 2403/51* (2013.01); *B65H 2404/61* (2013.01); *B65H 2404/725* (2013.01); *B65H 2405/112* (2013.01); *B65H 2405/1122* (2013.01); *B65H 2405/1124* (2013.01); *B65H 2511/10* (2013.01); *B65H 2511/11* (2013.01); *B65H 2511/21* (2013.01); *B65H 2701/113* (2013.01); *B65H 2701/1912* (2013.01)

(58) Field of Classification Search

CPC ..... B65H 29/52; B65H 31/20; B65H 31/36; B65H 31/34; B65H 2405/1124; B65H 2405/1122; B65H 2701/1912

USPC ..... 271/223

See application file for complete search history.

(56) References Cited

U.S. PATENT DOCUMENTS 6,311,971 B1 * 11/2001 Greer ..... B65H 29/22 270/58.08

7,784,777 B2 * 8/2010 Dobashi ..... B65H 29/6645 270/20.1

(Continued)

*Primary Examiner* — Jeremy R Severson

(74) *Attorney, Agent, or Firm* — Fenwick & West LLP

(57) ABSTRACT

Provided is a multi-banknote cassette with a movable stopper, which is capable of storing various kinds of banknotes at the same time. The multi-banknote cassette includes a movable stopper which is installed in a stack guide for guiding banknotes introduced into a cassette body of the banknote cassette toward a banknote stopper, and rotated to protrude from or retreat into a transfer path of the banknotes. When a banknote having a relatively small size among the banknotes inserted into the banknote cassette is introduced, the movable stopper is rotated to protrude from the stack guide and regulates the front end of the introduced banknote, and when a banknote having a relatively large size is introduced, the movable stopper is rotated to retreat into the stack guide, and a banknote stopper installed at the rear of the stack guide regulates the front end of the introduced bank.

8 Claims, 5 Drawing Sheets

(51) Int. Cl.
*G07D 7/17* (2016.01)
*B65H 31/36* (2006.01)

(56) References Cited

U.S. PATENT DOCUMENTS

| | | | | |
|---|---|---|---|---|
| 7,845,628 | B2 * | 12/2010 | Dobashi | B65H 29/6645 270/32 |
| 8,240,663 | B2 * | 8/2012 | Kramer | B65H 31/10 271/214 |
| 8,672,316 | B2 * | 3/2014 | Chiwata | B65H 31/02 271/161 |
| 2011/0031673 | A1 * | 2/2011 | Sugizaki | B65H 31/02 270/32 |
| 2016/0207722 | A1 * | 7/2016 | Holland-Letz | B65H 1/025 |

* cited by examiner

MULTI-BANKNOTE CASSETTE WITH MOVABLE STOPPER AND BANKNOTE STACKING METHOD THEREOF

CROSS-REFERENCE TO RELATED APPLICATION

This application claims priority under 35 U.S.C. § 119(a) to Republic of Korea Patent Application No. 10-2016-0021612 filed on Feb. 24, 2016, which is incorporated by reference herein in its entirety.

BACKGROUND

1. Technical Field

The present disclosure relates to a multi-banknote cassette with a movable stopper and a banknote stacking method thereof, and more particularly, to a multi-banknote cassette with a movable stopper, which is capable of storing various kinds of banknotes at the same time, and a banknote stacking method thereof. The multi-banknote cassette includes a movable stopper which is installed in a stack guide for guiding banknotes introduced into a cassette body of the banknote cassette toward a banknote stopper when the banknotes are deposited, and rotated to protrude from or retreat into a transfer path of the banknotes. When a banknote having a relatively small size among the banknotes inserted into the banknote cassette is introduced, the movable stopper is rotated to protrude from the stack guide and regulates the front end of the introduced banknote, and when a banknote having a relatively large size is introduced, the movable stopper is rotated to retreat into the stack guide, and a banknote stopper installed at the rear of the stack guide regulates the front end of the introduced bank. Therefore, the banknotes inserted into the banknote cassette are aligned and stacked in a storage space at a separator/stacker, regardless of the kinds or sizes of the banknotes. Such a structure can increase the discharge efficiency of banknotes through the separator/stacker when the banknotes are discharged, and easily handle various kinds of banknotes through one banknote cassette.

2. Related Art

In general, ATM (Automated Teller Machine) refers to an automation device which can assist a basic financial service such as deposit or withdrawal without a bank teller regardless of place and time. Through the ATM, a customer can withdraw or deposit a check and cash using a medium such as a card or bankbook.

Such an ATM can be operated even after the business close time of a bank. Furthermore, the ATM can be installed in various places such as a department store, supermarket and convenience store, and operated in unattended mode. Thus, the number of installed ATMs tends to increase.

Recently, a circulation-type ATM has been widely spread, which circulates banknotes deposited through financial transactions of customers. The circulation-type ATM increases the operability to thereby improve the convenience of use for customers.

The circulation-type ATM includes a deposit/withdrawal part, a banknote detection part, a temporary storage part, a plurality of banknote cassettes, a reject box and a transfer path. The deposit/withdrawal part receives deposited banknotes or discharges banknotes to be withdrawn. The banknote detection part detects the kind of a banknote and determines whether the banknote is normal. The temporary storage part temporarily stores a deposited banknote until a transaction is established. The plurality of banknote cassettes store deposited banknotes for the respective kinds, and separate and discharge the stored banknotes when the banknotes are withdrawn. The reject box collects overlapping banknotes or damaged banknotes among the banknotes discharged from the plurality of banknote cassettes. The transfer path is used to transfer deposited or withdrawn banknotes.

The circulation-type banknote cassette in the above-described ATM has the following structure. As illustrated in FIG. 1, the circulation-type banknote cassette includes a cassette body 10, a support plate 20, a separator/stacker 30, a stack guide 40, and a banknote stopper 50. The cassette body 10 forms a storage space 11 for storing banknotes therein. The support plate 20 supports banknotes 1 stacked in the storage space 11 while being lifted or lowered in the storage space 11. The separator/stacker 30 is installed at a banknote entrance of the cassette body 10, and stacks banknotes carried into the cassette body 10 in the storage space 11 or separates banknotes 1 discharged from the cassette body 10 one by one. The stack guide 40 guides the banknotes 1 introduced into the storage space by the separator/stacker 30. The banknote stopper 50 is installed on the opposite wall of the side where the separator/stacker 30 is installed, in the cassette body 10, and regulates the front ends of the banknotes guided by the stack guide 40 such that the banknotes are aligned and stacked in the storage space 11 of the cassette body 10.

In the circulation-type banknote cassette, when a banknote is carried, the separator/stacker introduces the banknote into the storage space, and the banknote introduced into the storage space is guided through the stack guide, and falls into the storage space while the front end of the banknote collides with the banknote stopper installed on the wall surface of the cassette body. During this process, the banknote is stacked over the support plate of the storage space while being aligned with the banknotes stored in the storage space.

Furthermore, when banknotes are discharged from the banknote cassette, the aligned and stacked banknotes are separated one by one through the separator/stacker, and then transferred through the transfer path outside the banknote cassette.

The ATM may include a plurality of banknote cassettes for various kinds of banknotes, or handle various kinds of banknotes through one banknote cassette in some cases. Recently, the use of a multi-banknote cassette capable of storing and handling various kinds of banknotes at the same time has increased in order to improve the utilization convenience of the ATM and to reduce the size of the ATM. The banknote cassette for various kinds of banknotes can store different kinds of banknotes at the same time.

The sizes of banknotes used in Korea are similar to each other. Thus, no problems may occur when one banknote cassette handles various kinds of banknotes. In other countries, however, various kinds of banknotes may have significantly different sizes from each other. In this case, when the conventional banknote cassette is applied to handle various kinds of banknotes, serious problems may occur.

That is, since the conventional banknote cassette uses one fixed banknote stopper, the conventional banknote cassette has difficulties in aligning and storing various kinds of banknotes having different sizes. Therefore, when the banknote cassette handles various kinds of banknotes having different sizes, various troubles such as jam may occur while the banknotes are circulated.

For this reason, Republic of Korea Patent No. 1,250,657 has disclosed a banknote cassette for various kinds of banknotes, which has two separate storage spaces in order to store two kinds of banknotes having different sizes in one cassette. In this case, however, the banknote cassette must have two storage spaces, two support plates and two separators/stackers. Therefore, the utilization efficiency of the space in the cassette is degraded while the manufacturing cost of the cassette is increased.

SUMMARY

Various embodiments are directed to a multi-banknote cassette with a movable stopper, which is capable of storing various kinds of banknotes at the same time, and a banknote stacking method thereof. The multi-banknote cassette includes a movable stopper which is installed in a stack guide for guiding banknotes introduced into a cassette body of the banknote cassette toward a banknote stopper when the banknotes are deposited, and rotated to protrude from or retreat into a transfer path of the banknotes. When a banknote having a relatively small size among the banknotes inserted into the banknote cassette is introduced, the movable stopper is rotated to protrude from the stack guide and regulates the front end of the introduced banknote, and when a banknote having a relatively large size is introduced, the movable stopper is rotated to retreat into the stack guide, and a banknote stopper installed at the rear of the stack guide regulates the front end of the introduced bank. Therefore, the banknotes inserted into the banknote cassette are aligned and stacked in a storage space at a separator/stacker, regardless of the kinds or sizes of the banknotes. Such a structure can increase the discharge efficiency of banknotes through the separator/stacker when the banknotes are discharged, and easily handle various kinds of banknotes through one banknote cassette.

In an embodiment, there is provided a multi-banknote cassette with a movable stopper, which is installed in an ATM (Automated Teller Machine) and stores various kinds of banknotes at the same time. The multi-banknote cassette may include: a cassette body having a banknote entrance/exit formed at one side thereof, and including an internal storage space for storing banknotes; a separator/stacker installed at the banknote entrance/exit of the cassette body, and stacking banknotes carried into the cassette body in the storage space or separating banknotes discharged from the cassette body one by one and transferring the separated banknotes; a banknote stopper installed on the opposite wall surface of the side at which the separator/stacker is installed, in the cassette body; a stack guide installed at the top of the storage space, and guiding the banknotes introduced into the storage space by the separator/stacker toward the banknote stopper; and a movable stopper rotatably installed in the stack guide, and rotated to retreat into the stack guide or protrude from the stack guide, wherein when a banknote introduced into the storage space has a relatively small size, the movable stopper is rotated to protrude from the stack guide, and regulates the front end of the introduced banknote, and when a banknote introduced into the storage space has a relatively large size, the movable stopper is rotated to retreat into the stack guide and the banknote stopper regulates the front end of the introduced banknote, such that various kinds of banknotes having different sizes are aligned and stacked in the storage space.

DETAILED DESCRIPTION

Exemplary embodiments will be described below in more detail with reference to the accompanying drawings. The disclosure may, however, be embodied in different forms and should not be constructed as limited to the embodiments set forth herein.

Figure 1:
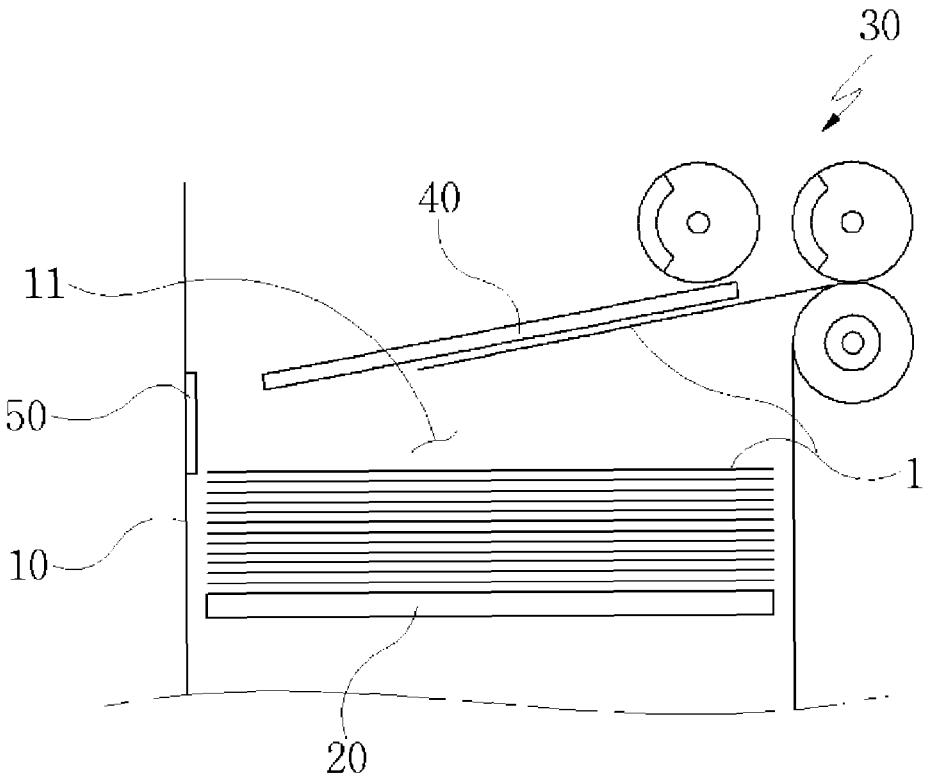
FIG. 1 is a diagram illustrating the structure of a conventional banknote cassette.
Figure 2:
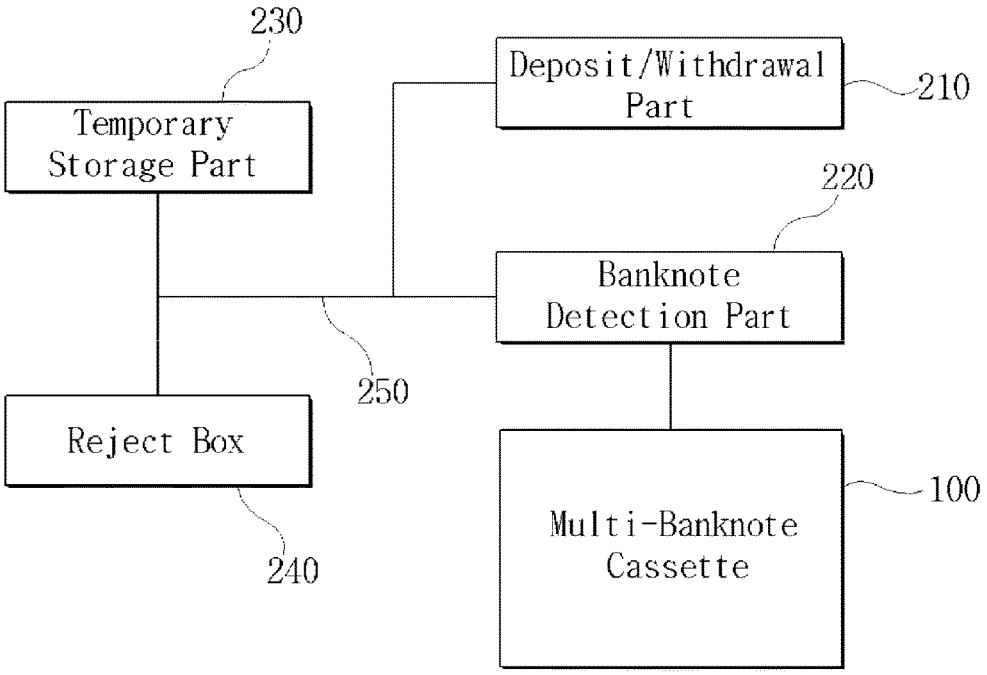
FIG. 2 is a diagram schematically illustrating the configuration of an ATM including a multi-banknote cassette according to an embedment of the present invention.

FIG. 2 is a diagram schematically illustrating the configuration of an ATM including a multi-banknote cassette according to an embedment of the present invention.

As illustrated in FIG. 2, the ATM with a multi-banknote cassette according to the embodiment of the present invention includes a deposit/withdrawal part 210, a banknote detection part 220, a temporary storage part 230, one or more multi-banknote cassettes 100, a reject box 240 and a transfer path 250. The deposit/withdrawal part 210 receives a deposited banknote or discharges a banknote to be withdrawn. The banknote detection part 220 detects the kind of a banknote, and determines whether the banknote is normal. The temporary storage part 230 temporarily stores a deposited banknote until a transaction is established. Each of the one or more multi-banknote cassettes 100 aligns and stores various kinds of banknotes having different sizes in one cassette at the same time. The reject box 240 collects overlapping banknotes or damaged banknotes among banknotes discharged from the multi-banknote cassette 100. The transfer path 250 is used to transfer a deposited or withdrawn banknote.

The ATM having the above-described configuration includes the multi-banknote cassette capable of storing various kinds of banknotes with different sizes at the same time. Thus, the ATM can store and handle various kinds of banknotes through one banknote cassette without a plurality of banknote cassettes for storing the respective kinds of banknotes. Therefore, since the manufacturing cost and size of the ATM can be reduced, the ATM can be effectively installed in various places.

Furthermore, even when deposited and stored banknotes have different sizes, the multi-banknote cassette can effectively align and stack the banknotes having different sizes in the storage space at the separator/stacker. Therefore, when various kinds of banknotes having different sizes are withdrawn through the separator/stacker, the banknotes can be effectively discharged without a trouble such as jam.

Figure 3:
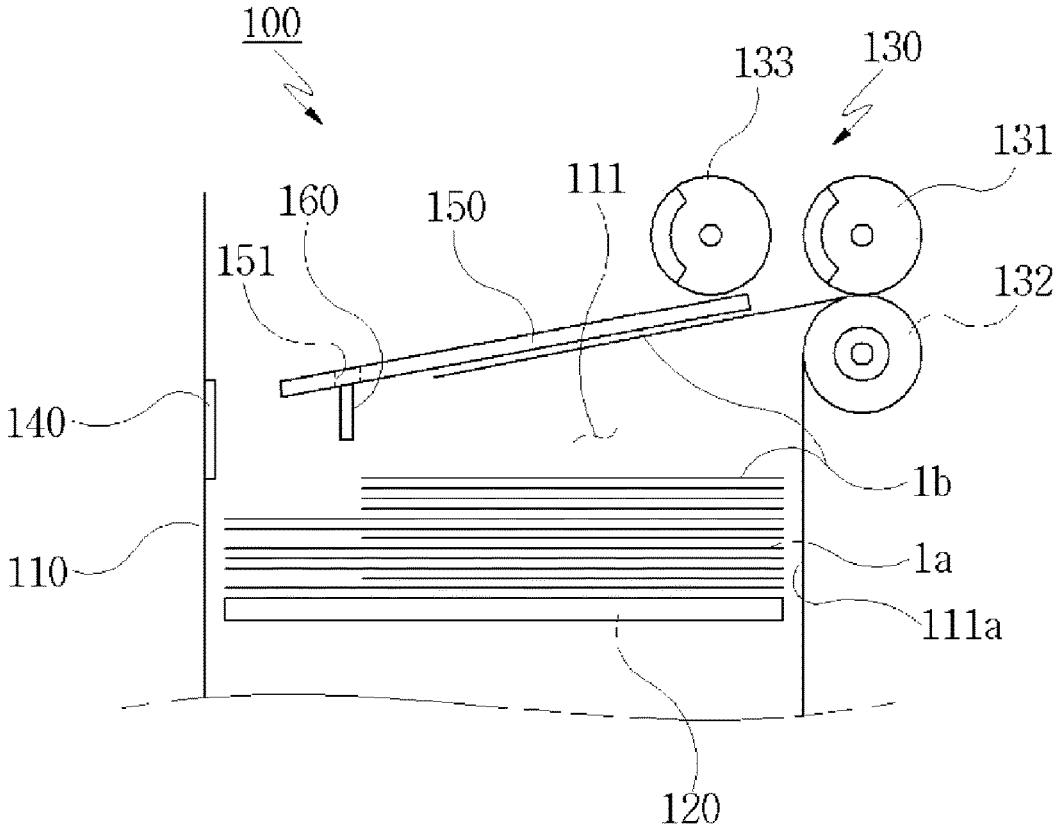
FIG. 3 is a diagram illustrating the internal structure of a multi-banknote cassette with a movable stopper according to an embodiment of the present invention.
Figure 4A:
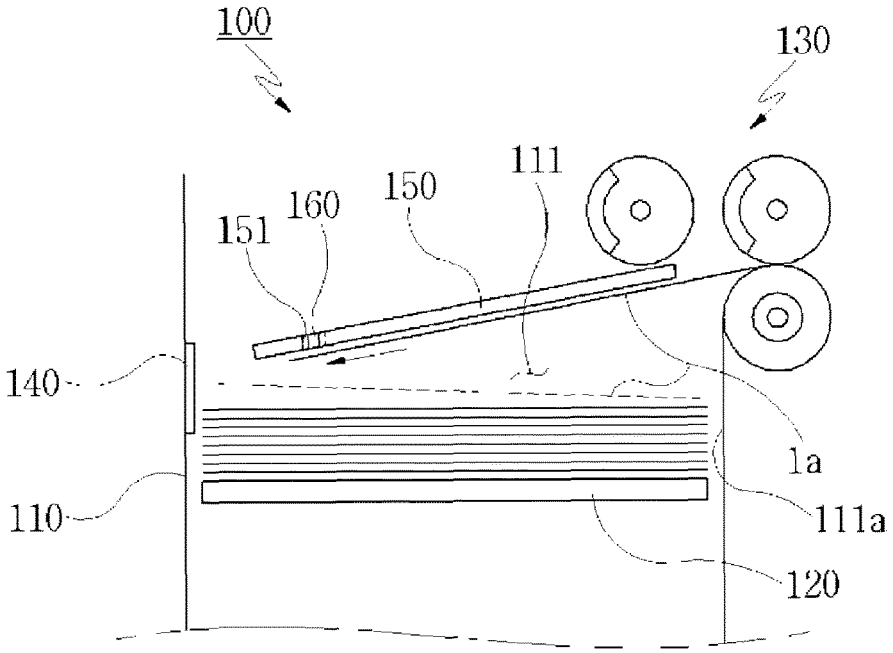
FIGS. 4A and 4B are diagrams illustrating an operation process of the multi-banknote cassette with a movable stopper according to the embodiment of the present invention.
Figure 4B:
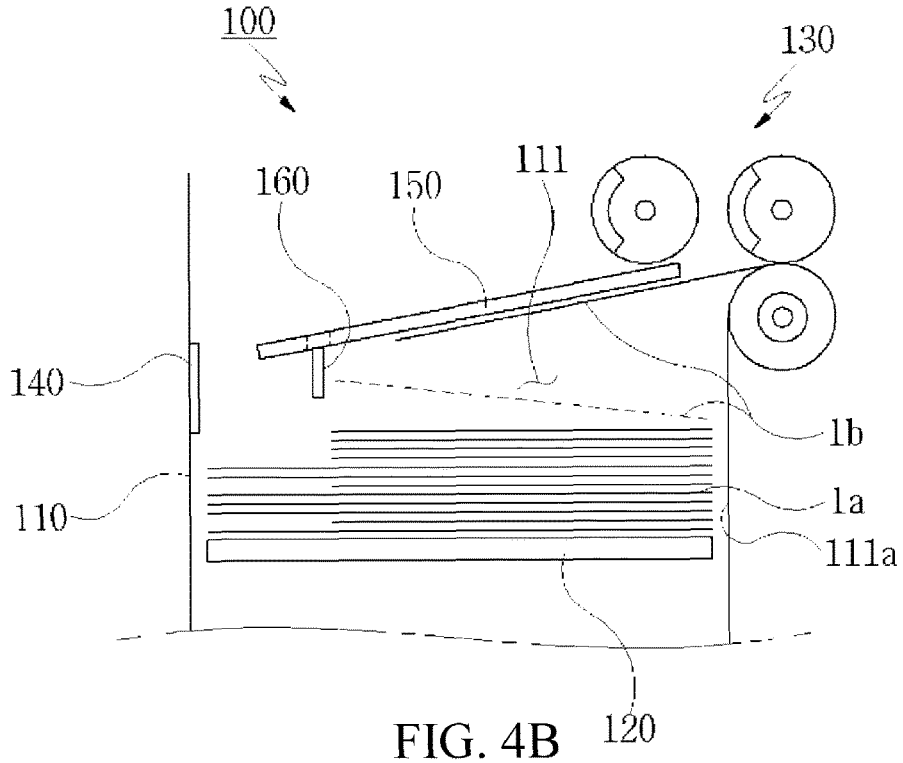

FIG. 3 is a diagram illustrating the internal structure of a multi-banknote cassette with a movable stopper according to an embodiment of the present invention, and FIGS. 4A and 4B are diagrams illustrating an operation process of the multi-banknote cassette with a movable stopper according to the embodiment of the present invention.

As illustrated in FIGS. 3 and 4, the multi-banknote cassette 100 with a movable stopper according to the embodiment of the present invention includes a cassette body 110, a support plate 120, a separator/stacker 130, a banknote stopper 140, a stack guide 150 and a movable stopper 160. The cassette body 110 has a banknote entrance/exit formed at one side thereof, and includes an internal storage space 111 for storing banknotes. The support plate 120 supports banknotes stacked in the storage space 111 while being lifted or lowered in the storage space 111. The separator/stacker 130 is installed at the banknote entrance/exit of the cassette body 10, and stacks banknotes carried into the cassette body 110 in the storage space 111 or separates banknotes discharged from the cassette body 110 one by one and transfer the separated banknotes. The banknote stopper 140 is installed on the opposite wall of the side at which the separator/stacker 130 is installed, in the cassette body 110. The stack guide 150 is installed at the top of the storage space 111, and guides banknotes introduced into the storage space 111 by the separator/stacker 130 toward the banknote stopper 140. The movable stopper 160 is rotatably installed in the stack guide, and rotated to retreat into the stack guide 150 or protrude from the stack guide 150.

As described above, the multi-banknote cassette with a movable stopper according to the embodiment of the present invention includes the movable stopper which is formed in the stack guide for guiding banknotes introduced into the cassette body of the banknote cassette toward the banknote stopper when the banknotes are deposited and stored, and rotated to protrude from or retreat into the transfer path of the banknotes. Thus, when a banknote having a relatively small size among the banknotes carried into the banknote cassette is introduced, the movable stopper is rotated to protrude from the stack guide, and regulates the leading end of the introduced banknote. When a banknote having a relatively large size is introduced, the movable stopper is rotated to retreat into the stack guide, and the banknote stopper installed at the rear of the stack guide regulates the front end of the introduced banknote. Therefore, the banknotes carried into the banknote cassette are aligned and stacked in the storage space at the separator/stacker, regardless of the kinds or sizes of the carried banknotes. Such a structure can increase the discharge efficiency of banknotes through the separator/stacker when the banknotes are discharged from the banknote cassette, thereby easily handling various kinds of banknotes having different sizes through one banknote cassette.

Hereafter, the structure of the multi-banknote cassette with a movable stopper, which can align and store various kinds of banknotes having different sizes at the same time, will be described in more detail with reference to the accompanying drawings.

In the following descriptions, among various kinds of banknotes which are stored in the multi-banknote cassette, a banknote having a relatively large size is defined as a first banknote 1*a*, and a banknote having a relatively small size is defined as a second banknote 1*b*.

The cassette body 110 is a box-shaped case for storing banknotes, and has a banknote entrance/exit formed at one side of the upper portion thereof and a storage space 111 for storing banknotes therein.

At this time, the storage space 111 may be formed according to the size of the first banknote 1*a* larger than the second banknote 1*b*, in order to store both of the first and second banknotes having different sizes.

The support plate 120 is installed at the bottom of the storage space 111 in which banknotes are stored, and supports the banknotes stacked in the storage space 111 while being lifted or lowered in the storage space 111.

The separator/stacker 130 is installed at the banknote entrance/exit of the cassette body 110, and stacks banknotes carried into the cassette body 110 in the storage space 111, or separates banknotes discharged from the cassette body 110 one by one and transfers the separated banknotes to the transfer path outside the banknote cassette 100.

As illustrated in FIG. 3, the separator/stacker 130 includes a feed roller 131, a separation roller 132, and a pickup roller 133. The feed roller 131 is installed at the banknote entrance/exit of the cassette body 110, and transfers a banknote carried into the storage space 111 or discharged from the storage space 111. The separation roller 132 is disposed facing the feed roller 131, and transfers a banknote. When a banknote is discharged from the storage space 111, the separation roller 132 is pressed against the bottom surface of the banknote transferred through the feed roller 131, and separates another banknote which is transferred at the same time. The pickup roller 133 is installed at the top of the storage space 111, picks up a banknote stored in the storage space 111 when the banknote is discharged from the storage space 111, and transfers the banknote toward the feed roller 131.

That is, when banknotes are carried into the storage space 111, the banknotes are transferred into the storage space 111 through the feed roller 131 and the separation roller 132, and stacked over the support plate 120. On the other hand, when banknotes stacked in the storage space 111 are discharged, the support plate 120 is lifted until the banknote stacked at the uppermost part of the support plate 120 is pressed against the pickup roller 133. Then, the stacked banknotes are sequentially picked up through the pickup roller 133 and discharged and transferred through the feed roller 131. Simultaneously, another banknote which is pressed against the bottom surface of the discharged and transferred banknote and transferred at the same time as the banknote is separated through the separation roller 132 facing the feed roller 131. Therefore, the banknotes transferred through the feed roller 131 are discharged and transferred one by one.

The stack guide 150 is a guide plate installed at the top of the storage space 111, and serves to guide a banknote introduced into the storage space 111 by the separator/stacker 130 such that the banknote is reliably stacked in the storage space 111.

As illustrated in FIG. 3, the stack guide 150 is installed at the top of the storage space 111 such that the end thereof is inclined downward, and guides a banknote introduced into the storage space 111 through the feed roller 131 and the separation roller 132 of the separator/stacker 130 toward the banknote stopper 140 installed on the wall surface of the cassette body 110.

The stack guide 150 has a mounting groove in which the movable stopper 160 is mounted.

The banknote stopper 140 is installed on the opposite wall surface of the side at which the separator/stacker 130 is installed, in the cassette body 110. When banknotes are stacked, the banknote stopper 140 regulates the front ends of the banknotes which are introduced while being guided through the stack guide 150. Therefore, the banknotes can be aligned and stored in the storage space 111.

That is, as illustrated in FIG. 4A, the front end of a banknote which is guided to the stack guide 150 through the separator/stacker 130 and introduced into the storage space 111 collides with the banknote stopper 140 installed on the wall surface of the cassette body 110. At this time, the banknote stopper 140 can correct the skew of the banknote while slowing the entry speed of the colliding banknote.

Thus, the falling banknote can be stably aligned and stacked over the support plate 120 of the storage space 111.

At this time, the banknote stopper 140 is installed on the opposite wall surface of the side at which the separator/stacker 130 is installed, in the cassette body 110, and regulates the front ends of the first banknotes 1*a* guided along the stack guide 150. The first banknotes 1*a* are stacked while the rear ends thereof are aligned with the storage space wall surface 111*a* at the side where the separator/stacker 130 is installed. The second banknotes 1*b* having a smaller size than the first banknotes 1*a* are stacked while being aligned with the storage space wall surface 111*a* by the movable stopper 160 installed in the stack guide 150.

That is, the movable stopper 160 is installed in the mounting groove 151 formed in the stack guide 150, and rotated to protrude from or retreat into the stack guide 150 through a driving unit (not illustrated). According to banknote information detected by the banknote detection part, the movable stopper 160 is rotated to protrude from the stack guide 150 only when the second banknote 1*b* having a smaller size than the first banknote 1*a* between the first and second banknotes 1*a* and 1*b* is introduced into the banknote cassette 100, and regulates the front end of the second banknote 1*b*. Thus, the second banknotes 1*b* are stacked while the rear ends of the second banknotes 1*b* are aligned with the storage space wall surface 111*a* at the separator/stacker 130 by a repulsive force.

Figure 5A:
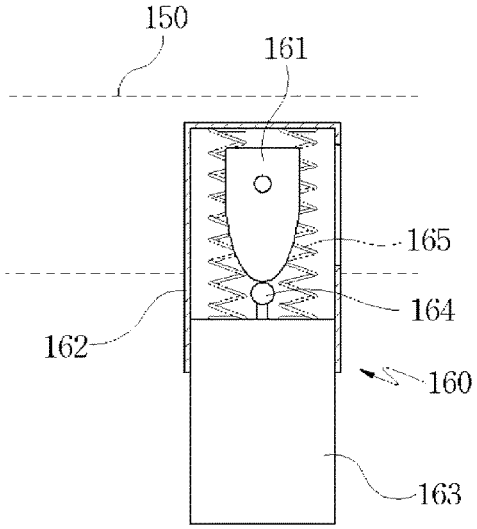
FIGS. 5A and 5B are diagrams illustrating the internal structure and operation process of the movable stopper according to the embodiment of the present invention.
Figure 5B:
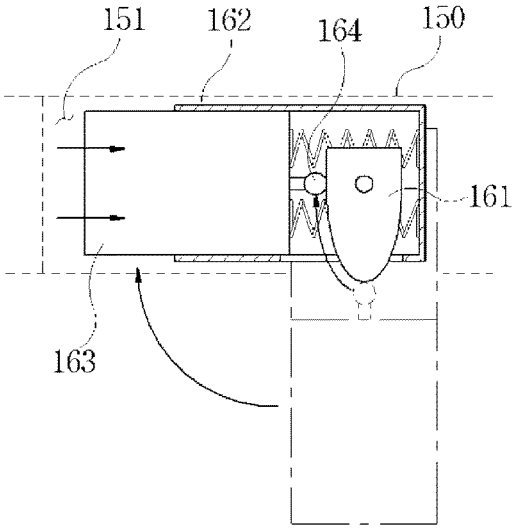

FIGS. 5A and 5B are diagrams illustrating the internal structure and operation process of the movable stopper according to the embodiment of the present invention.

As illustrated in FIGS. 5A and 5B, the movable stopper 160 includes a fixed cam 161, a stopper case 162, a stopper body 163, a tension spring 165 and a driving unit (not illustrated). The fixed cam 161 is fixed at one side of the mounting groove 151 of the stack guide 150. The stopper case 162 has one side axially fixed to the fixed cam 161 so as to rotate around the fixed cam 161, and includes an opening formed at the other side thereof. The stopper body 163 is inserted into the opening of the stopper case 162 so as to move inside the stopper case 162, and has a contact protrusion 164 formed at one side thereof, the contact protrusion being supported by the outer circumferential surface of the fixed cam 161. The tension spring 165 is installed in the stopper case 162, and has one end fixed to one side of the stopper body 163 and the other end fixed to the inner wall of the stopper case 162 facing the one side of the stopper body 163. The tension spring 165 applies a tensile force to the stopper body 163 such that the stopper body 163 is pulled to the inside of the stopper case 162. The driving unit rotates the stopper case 162.

At this time, the fixed cam 161 fixed at one side of the mounting groove 151 of the stack guide 150 has an elliptical surface. Thus, the vertical width of the fixed cam 161 is larger than the horizontal width thereof.

The movable stopper 160 is rotated in the direction crossing the banknote entry direction by the driving unit (not illustrated). As illustrated in FIGS. 5A and 5B, the movable stopper 160 is rotated by 90° and protrudes from the stack guide 150, or rotated in the reverse direction by 90° and retreats into the mounting groove 151 of the stack guide 150.

At this time, when the movable stopper 160 is rotated through the operation of the driving unit (not illustrated) and vertically protrudes from the stack guide 150 as illustrated in FIG. 5A, the stopper body 163 installed in the stopper case 162 protrudes from the stack guide 150 and regulates the front end of a banknote guided by the stack guide 150, in case where the banknote is introduced into the storage space 111.

At this time, when the movable stopper 160 vertically protrudes from the stack guide 150, the contact protrusion 164 of the stopper body 163 coupled to the stopper case 162 is supported by the fixed cam 161 while being contacted with the major-axis portion of the fixed cam 161. Therefore, the stopper body 163 protrudes to the outside through the opening of the stopper case 162, thereby easily regulating the front end of the banknote guided by the stack guide 150.

Furthermore, when the movable stopper 160 is rotated by the driving unit (not illustrated) and retreats into the mounting groove 151 of the stack guide 150 as illustrated in FIG. 5B, the stopper case 162 is rotated by 90° through the driving unit. Specifically, the stopper case 162 and the stopper body 163 coupled to the stopper case 162 are rotated to retreat into the mounting groove 151 of the stack guide 150. Therefore, when a banknote is introduced into the storage space 111, the banknote guided by the stack guide 150 can pass the movable stopper 160.

During the process in which the movable stopper 160 is rotated to retreat into the mounting groove 151 of the stack guide 150, the contact protrusion 164 of the stopper body 163, which was supported by the major-axis portion of the fixed cam 161, is moved along the outer circumferential surface of the fixed cam 161 and supported by the minor-axis portion of the fixed cam 161, and the stopper body 163 is partially inserted into the stopper case 162. Thus, while the entire length of the movable stopper 160 is reduced during the retreat process, the movable stopper 160 is rotated to retreat into the mounting groove 151 of the stack guide 150, which makes it possible to prevent the end of the stopper body 163 from interfering with the banknote stacked at the uppermost part of the storage space 111.

The movable stopper 160 having the above-described operating structure is rotated to protrude from or rotated to retreat into the stack guide 150, according to banknote information detected by the banknote detection part installed in the ATM. As illustrated in FIG. 4A, when the first banknotes 1*a* are introduced into the banknote cassette 100 in a state where the movable stopper 160 retreats into the mounting groove 151 of the stack guide 150, the movable stopper 160 maintains the retreat state such that the first banknotes 1*a* introduced into the banknote cassette 100 are guided along the stack guide 150 and stacked while being aligned with the storage space wall surface 111*a* at the separator/stacker 130 by the banknote stopper 140.

Furthermore, when the second banknotes 1*b* having a smaller size than the first banknotes are introduced into the banknote cassette 100, the movable stopper 160 is rotated to protrude from the stack guide 150 as illustrated in FIG. 4B. Then, the front ends of the second banknotes 1*b* introduced into the banknote cassette 100 are regulated by the movable stopper 160, while the second banknotes 1*b* are guided along the stack guide 150. Thus, the second banknotes 1*b* are stacked while being aligned with the storage space wall surface 111*a* at the separator/stacker 130.

That is, the front ends of the second banknotes 1*b* guided along the stack guide 150 collide with the stopper body 163 of the movable stopper. At this time, the movable stopper 160 slows the speed of the colliding banknotes and corrects the skew of the banknotes. Thus, the falling second banknotes 1*b* can be stably aligned and stacked over the support plate 120 of the storage space 111.

The multi-banknote cassette with a movable stopper according to the embodiment of the present invention includes the banknote stopper and the movable stopper which are installed in the cassette body and correspond to the first and second banknotes having different sizes, respectively, and can align and stack the first and second banknotes having different sizes in one storage space at the same time. Thus, when banknotes are discharged from the banknote cassette, the first and second banknotes having different sizes can be separated and discharged through the separator/stacker without a trouble. Therefore, banknotes having different sides can be handled through one banknote cassette.

In the multi-banknote cassette with a movable stopper according to the embodiment of the present invention, when a banknote having a relatively small size among banknotes inserted into the banknote cassette is introduced, the movable stopper is rotated to protrude from the stack guide, and regulates the front end of the introduced banknote, and when a banknote having a relatively large size is introduced, the movable stopper is rotated to retreat into the stack guide, and the banknote stopper installed at the rear of the stack guide regulates the front end of the introduced banknote. Therefore, the banknotes are stacked in the storage space of the banknote cassette while being aligned with the storage space wall surface at the separator/stacker, regardless of the kind or size of the banknotes inserted into the banknote cassette. Thus, when the banknotes are discharged from the banknote cassette, the discharge efficiency of the banknotes through the separator/stacker can be improved, which makes it possible to easily handle various kinds of banknotes through one banknote cassette.

Furthermore, during the process in which the movable stopper retreats into the stack guide, the stopper body protruding from the stopper case of the movable stopper is partially inserted into the stopper case. That is, while the length of the movable stopper is shortened, the movable stopper is rotated to retreat into the stack guide, which makes it possible to prevent the end of the movable stopper from interfering with the banknote stacked at the uppermost part of the storage space.

Furthermore, the multi-banknote cassette with a movable stopper according to the embodiment of the present invention aligns and stacks banknotes in one storage space at the separator/stacker, regardless of the kinds or sizes of the banknotes. Thus, the multi-banknote cassette can increase the spatial efficiency thereof, thereby contributing to reducing the size of the ATM.

Furthermore, the movable stopper structure according to the embodiment of the present invention can be applied not only to a multi-banknote cassette but also to a banknote receiving/dispensing unit of ATM.

While various embodiments have been described above, it will be understood to those skilled in the art that the embodiments described are by way of example only. Accordingly, the disclosure described herein should not be limited based on the described embodiments.

What is claimed is:

1. A multi-banknote cassette with a movable stopper, which is installed in an automated teller machine (ATM) and stores various kinds of banknotes at the same time, comprising:

a cassette body having a banknote entrance/exit formed at one side thereof, and including an internal storage space for storing banknotes;

a separator/stacker installed at the banknote entrance/exit of the cassette body, and stacking banknotes carried into the cassette body in the storage space or separating banknotes discharged from the cassette body one by one and transferring the separated banknotes;

a banknote stopper installed on an opposite wall surface of the side at which the separator/stacker is installed, in the cassette body;

a stack guide installed at a top of the storage space, and guiding the banknotes introduced into the storage space by the separator/stacker toward the banknote stopper; and a movable stopper rotatably installed in the stack guide, and rotated to retreat into the stack guide or extend from the stack guide, wherein when a banknote introduced into the storage space has a first size, the movable stopper is rotated to extend from the stack guide, and regulates a front end of the introduced banknote, when a banknote introduced into the storage space has a second size larger than the first size, the movable stopper is rotated to retreat into the stack guide and the banknote stopper regulates the front end of the introduced banknote, such that various kinds of banknotes having different sizes are aligned and stacked in the storage space, and wherein the movable stopper is rotated to retreat into the stack guide or extend from the stack guide according to the size of a banknote introduced into the storage space, based on banknote detection information of a banknote detection part installed in the ATM.

2. The multi-banknote cassette of claim 1, wherein the movable stopper comprises:

a fixed cam fixed on the stack guide;

a stopper case having one side axially fixed to the fixed cam so as to rotate around the fixed cam, and including an opening formed at another side thereof;

a stopper body inserted and coupled to the opening of the stopper case so as to move inside the stopper case, and having a contact protrusion formed at one side thereof, the contact protrusion being supported by an outer circumferential surface of the fixed cam;

a tensile spring installed in the stopper case, having one end fixed to one side of the stopper body and the other end fixed to the case inner wall facing the one side of the stopper body, and applying a tensile force to the stopper body such that the stopper body is pulled to the inside of the stopper case; and a driving unit rotating the stopper case.

3. The multi-banknote cassette of claim 2, wherein the fixed cam has an elliptical surface, and a vertical width of the fixed cam is larger than a horizontal width thereof.

4. The multi-banknote cassette of claim 3, wherein when the movable stopper retreats into the stack guide, the contact protrusion of the stopper body is supported by a minor-axis portion of the fixed cam, and the stopper body is partially inserted into the stopper case such that an entire length of the movable stopper is shortened.

5. The multi-banknote cassette of claim 1, wherein the stack guide has a mounting groove in which the movable stopper is mounted, and when the movable stopper is rotated to retreat, the movable stopper retreats into the mounting groove.

6. The multi-banknote cassette of claim 1, wherein the movable stopper is rotated in a direction perpendicular to a banknote entry direction, and retreats into the stack guide or extends from the stack guide.

7. A banknote stacking method applied to a multi-banknote cassette which is installed in an ATM and stores various kinds of banknotes at the same time, guiding banknotes introduced into a storage space of the banknote cassette by a movable stopper installed in a stack guide, retreating the movable stopper into the stack guide, and extending the movable stopper from the stack guide, wherein when a banknote introduced into the storage space has a first size, the movable stopper is rotated to extend from the stack guide, and regulates a front end of the introduced banknote, and when a banknote introduced into the storage space has a second size larger than the first size, the movable stopper is rotated to retreat into the stack guide, and a banknote stopper installed on a wall surface of the banknote cassette regulates the front end of the introduced banknote, such that various kinds of banknotes having different sizes are aligned and stacked in the storage space, wherein the movable stopper is rotated to retreat into the stack guide or extend from the stack guide according to the size of a banknote introduced into the storage space, based on banknote detection information of a banknote detection part installed in the ATM.

8. The banknote stacking method of claim 7, wherein the movable stopper is rotated in a direction perpendicular to the direction in which banknotes are introduced into the storage space, and retreats into the stack guide or extends from the stack guide.

* * * * *